US006076866A

United States Patent [19]

Prevot et al.

[11] Patent Number: 6,076,866

[45] Date of Patent: Jun. 20, 2000

[54] LOCKING FITTING FOR SLIDING LEAF AND BURGLARY-SAFE DEVICE FOR SUCH A FITTING

[75] Inventors: Gérard Prevot, Willerwald; Mih Philippe, Sarrebourg, both of France

[73] Assignee: Ferco International Ferrures et Serrures de Batiment, Sarrebourg, France

[21] Appl. No.: 09/103,889

[22] Filed: Jun. 24, 1998

[30] Foreign Application Priority Data

Jun. 27, 1997 [FR] France ..... 97 08317

[51] Int. Cl.[7] ..... E05C 1/06

[52] U.S. Cl. ..... 292/140; 292/DIG. 46; 292/346; 292/340; 49/394

[58] Field of Search ..... 292/140, DIG. 53, 292/DIG. 46, DIG. 54, 346, 340, 337; 49/394, 462, 501

[56] References Cited

U.S. PATENT DOCUMENTS

| | | | |
|---|---|---|---|
| 2,964,344 | 12/1960 | Rich | 292/DIG. 46 |
| 3,002,777 | 10/1961 | Shane, Jr. | 292/DIG. 46 |
| 4,160,560 | 7/1979 | Hauber | 292/DIG. 46 |
| 4,480,862 | 11/1984 | Fleming | 292/162 |
| 5,141,267 | 8/1992 | Vigreux | 292/DIG. 46 |
| 5,421,627 | 6/1995 | Yane | 292/DIG. 46 |

FOREIGN PATENT DOCUMENTS

| | | | |
|---|---|---|---|
| 3128725 | 2/1983 | Germany | 292/346 |

*Primary Examiner*—Teri Pham
*Attorney, Agent, or Firm*—Harrison & Egbert

[57] ABSTRACT

A burglarproof device for a sliding leaf including at least a locking organ capable of being protruding with respect to the front edge of the sliding leaf, so as to cooperate with a keeper inserted against the corresponding stile of the sash-frame. This burglarproof device includes a burglar-safe case defined by an inner wall and an outer wall extending perpendicularly to a bottom provided with an elongated slot through which passes the locking organ; and a keeper formed by a cap including an opening for receiving the locking organ, this cap being capable of covering a bearing capable of being inserted in the fillister of the sash-frame. This cap has a shape without undercut impeding a tool from being hooked in during an attempt of burglary.

4 Claims, 1 Drawing Sheet

LOCKING FITTING FOR SLIDING LEAF AND BURGLARY-SAFE DEVICE FOR SUCH A FITTING

BACKGROUND OF THE INVENTION (1) Field of the Invention

The invention relates to a burglarproof device for a locking fitting, comprising at least a locking organ, such as a hook bolt or the like, capable of protruding with respect to the front edge of said leaf, so as to co-operate with a keeper inserted against the corresponding stile of the sash-frame.

This invention will find its application in the field of building ironmongery and in particular relates to fittings for a sliding leaf.

(2) Description of the Prior Art

As a matter of fact, there are already known various locking fittings meeting the above-description. In particular, there is known a locking fitting for a sliding leaf of a door, window or the like comprising at least an operating rod installed in a groove or a notch present in the fillister of the front stile of this sliding leaf. As a matter of fact, this operating rod moves at the rear of a faceplate, under the action of an adequate control mechanism, this in order to bring one or several locking organs, such as a hook bolt or the like, into an unlocked or, reversely, a locked position. In this latter case, this locking organ co-operates with a keeper inserted against the corresponding stile of the sash-frame.

The problem that such locking fittings present resides in the accessibility to the locking organ or organs or also to the keeper through the fillister of the door or window. Thus, it can not seldom be observed that in the event of burglary the opening of such a door or window has been controlled through a direct action exerted on this or these locking organs. Furthermore, one has been able to notice that a failed attempt of burglary carried out in such a way in most cases results into the malfunctioning of the locking fitting. A locking fitting, such as a hook bolt, made directly integral with an operating rod and protruding from the faceplate through an opening in this latter indeed remains relatively fragile per se, depending on the kind of stress directly imparted to this hook bolt. In addition, very often the keepers have, at their inner and/or outer side faces, an "undercut" shape allowing the insertion of a tool, such as a screwdriver or the like, which also results in seriously damaging this keeper, in particular its securing to the sash-frame.

Furthermore, in particular from EP-0,262,067, it is known a locking fitting for a sliding-type door or window the leaf and the sash-frame of which are designed through an assembly of tubular profile bars made of synthetic material or aluminum, such profile bars defining, at the level of the front edge of said sliding leaf and also at the level of the corresponding stile of the sash-frame, U-shaped grooves. Through such a configuration, this front stile of the leaf is capable of fitting on the corresponding stile of the sash-frame while covering said U-shaped groove of this latter.

Finally, it seems that through such a particular configuration of the profile bars the sliding door or window is comprised of and in which are accommodated the hook bolt and the keeper of the locking fitting, such profile bars, whether they are made of aluminum or, all the more so, of synthetic material, are, in fact, in no way capable of somehow withstanding the aggression with a tool, such as a screwdriver or the like, that a burglar may use during an attempt of burglary.

SUMMARY OF THE INVENTION

Thus, this invention is aimed at coping with all the above-mentioned drawbacks, this through allowing to make inaccessible the locking organs or also the keepers of the fitting, whether the profile bars the sliding leaf and the sash-frame are comprised of have or not a particular configuration as described above. This results in an increased safety of these locking fittings while impeding their deterioration due to an attempt of burglary.

Indeed, the invention relates to a burglarproof device for a locking fitting for a sliding leaf, of the kind including at least a locking organ, such as a hook bolt, capable of being protruding with respect to the front edge of the sliding leaf, with a view to co-operating with a keeper inserted against the corresponding stile of the sash-frame, characterized in that it includes:

a burglarproof case defined by an inner wall and an outer wall extending, from a bottom which they are made integral with, parallelly to the plane of the sliding leaf at the level of the front edge of this latter, said bottom of the burglarproof case capable of being fixed against a faceplate and including an elongated slot through which passes the locking organ and the dimensions of which are adapted to the travel of this latter;

and a keeper formed by a cap including, in its front portion, an opening for receiving the locking organ, whereas, in its rear portion, this cap is capable of covering bearing means capable of being inserted in the fillister of the sash-frame, between its rear portion and its front portion, said cap having a shape without undercut nor unevenness, nor set-back, which impedes a tool from being hooked in during an attempt of burglary.

The advantages resulting from this invention obviously reside in that a locking fitting for a sliding leaf provided with such a burglarproof device proves invulnerable to the attacks it is likely to suffer at the level of its organs arranged in the fillister. It should be noted that such a burglarproof device uses after all very simple means that are in no case prejudicial to the reliability or the performance of such a locking fitting and that, in addition, are of a negligible cost.

The invention will be better understood when reading the following description with reference to the drawings showing one embodiment.

DESCRIPTION OF THE PREFERRED EMBODIMENTS

Figure 1:
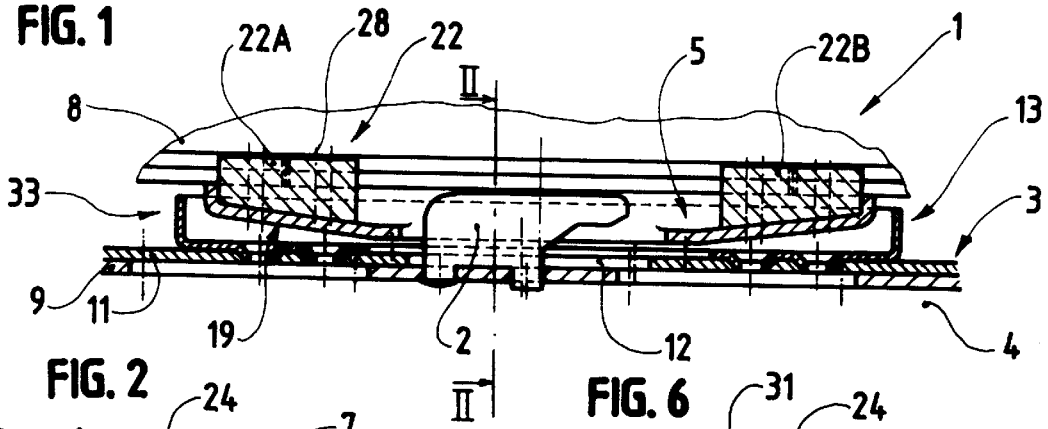
FIG. 1 is a schematical partial cross-sectional view of a burglarproof device according to the invention with which is provided a locking fitting for a sliding leaf and including a locking organ in the shape of a hook bolt co-operating with a keeper inserted in the fillister of the sash-frame.

As can be seen in FIG. 1 of the attached drawing, this invention relates to the field of the locking fittings in particular for sliding leaves of doors, windows or the like. In fact, of such a locking fitting 1 has been shown in FIG. 1 only a locking organ 2, here in the shape of a hook bolt, that is protruding with respect to the front edge 3 of this sliding leaf 4 so as to co-operate with a keeper 5 that is, in turn, inserted in the fillister 6 of the corresponding stile 7 of the sash-frame 8.

Figure 2:
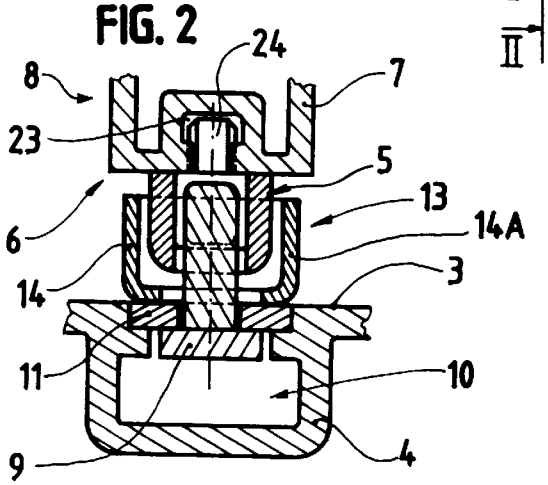
FIG. 2 is a cross-sectional view according to II—II of FIG. 1.

One understands very well that such a locking fitting 1 can receive several locking organs 2 that, in this case and as shown in FIGS. 1 and 2, can be operated by means of one or several operating rods 9 arranged in a groove or in a cutout 10 that is, as a matter of fact, provided for at the level of the front edge 3 of the sliding leaf 4.

In fact, such an operating rod 9 then moves at the rear of a faceplate 11 including one or several openings 12 for the passing through of the locking organ or organs 2. In this respect, it should be noticed that, like the hook bolt shown in FIGS. 1 and 2, this or these locking organs 2 may, as the case arises, be made directly integral with the operating rod or rods 9.

These latter are operated through an adequate control mechanism (not shown) operated, in turn, by a handle and, should the case arise, completed with a locking mechanism including a key member, such as a barrel.

It is also important to state that as far as the keeper or keepers 5 arranged in the fillister 6 of the sash-frame 8 are concerned, these may, as shown in FIG. 2, be fully visible and protruding at the level of this fillister 6, but they may also be accommodated in a U-shaped groove that defines, at the level of this fillister 6, the profile bar, e.g. of the metallic or plastic type, corresponding to the stile 7 of the sash-frame 8.

Anyway, this invention relates in particular to a burglarproof device 33 for such locking fittings for a sliding leaf. This burglarproof device includes, on the one hand, a burglarproof case 13 defined by at least an inner wall 14 and an outer wall 14A, extending parallel to the plane of the sliding leaf 4, at the level of the front edge 3 of this latter and on both sides of a locking organ 2, between these walls 14, 14A being capable of fitting the keeper 5 inserted against the sash-frame 8 when the sliding leaf 4 is closed against this latter.

Thus, this case 13 may, as shown in FIGS. 1 through 4, completely cover the keeper 5, the walls 14, 14A being connected by end walls 15, 15A, which are semi-circularly shaped here, while being made integral, like these latter, with a bottom 16 capable of being fixed, through riveting, screwing, welding or the like, against the faceplate 11. Thus, this bottom 16 of the case 13 includes, besides the openings 17 for the eventual passing through of fixing organs, an elongated slot 18 through which passes the locking organ 2 and the dimensions of which are adapted to the travel of this latter.

In the particular case in which the keeper 5 is hidden in a groove provided for in the fillister 6 of the sash-frame 8, it is possible that between the keeper 5 and the walls that sidely delimit the groove cannot be inserted the inner 14 and outer 14A walls of the case 13. Under these circumstances, these inner 14 and outer 14A walls of the case 13 protect the keeper 5 by locating themselves out of the groove, on both sides of the walls that delimit it sidely. Under these circumstances, these inner 14 and outer 14A walls are independent from the end walls 15, 15A, which, as far as they are concerned, fit in said groove, by being located above and under the keeper 5.

In this respect, the burglarproof device includes, on the other hand, a keeper 5 with the particular features. Thus, this latter is defined, as can be seen in FIGS. 1, 2 and 5 through 7, by a cap 19 including in its front portion, in front of the locking organ 2, an opening 20 allowing, as a matter of fact, the insertion and the hooking in of this locking organ 2, here shown in the shape of a hook bolt. At the level of its rear portion 21, this cap 19 covers bearing means 22 which it is made integral with and completing the keeper 5. Finally, these bearing means 22 are aimed at ensuring the fixing of this keeper 5 in the fillister 6 of the stile 7 corresponding to the sash-frame 8.

Turning back in particular to the cap 19, this latter has, between its rear portion 21 and its front portion including the opening 20, a shape without undercut nor unevenness, nor setback that could allow it to be seized or hooked in by means of a tool, e.g. a screwdriver or the like. This finally prevents any attempt to tear off this keeper 5. It should be noticed that such a cap 19 may be manufactured through molding, deep drawing or a similar process.

As regards the bearing means 22, they are, as already mentioned above, adapted to the nature and the shape of the fillister 6 of the sash-frame 8. In this respect, when this latter is in the shape of an assembly of metallic or plastic profile bars, there is usually defined, in the fillister 6, a T-shape groove 23 aimed at contributing, as a matter of fact, to the fixing of organs of locking fittings. Under these circumstances, the bearing means 22 advantageously include a shoe 24 aimed at being inserted into the groove 23 and an emerging portion 25 of this latter on which is positioned the cap 19.

The bearing means 22 are advantageously comprised of two elementary parts 22A and 22B each including a shoe 24 and an emerging portion 25, these elementary parts 22A and 22B thus being spaced apart from each other so as to leave a passageway for the locking organ 2 aimed at passing through the opening 20 of the cap 19.

In fact, as can be seen in FIG. 1, these elementary parts 22A and 22B forming the bearing means 22 are accommodated, viz. as regards their emerging portion 25, under the cap 19 at the level of the ends 26, 27 of this latter.

The fixing organs 28, such as screws, preferably simultaneously ensure the connection between the cap 19 and the bearing means 22, on the one hand, and between these latter and the sash-frame 8, on the other hand. Thus, these fixing organs 28 simultaneously pass through the cap 19, in its front portion, and the elementary parts 22A and 22B, in order to co-operate with the carpentry.

Figure 6:
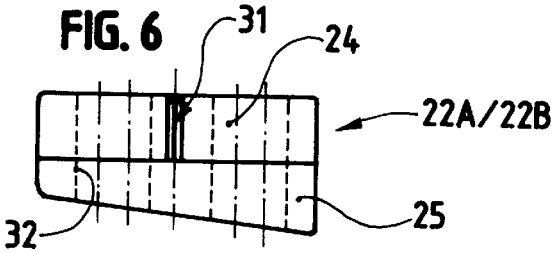
FIG. 6 is a schematical and elevational view of a bearing plate for FIG. a keeper.
Figure 7:
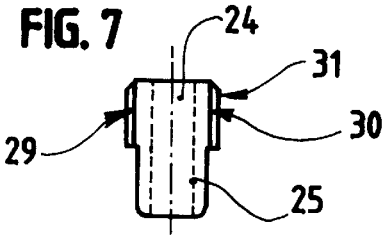
FIG. 7 is a schematical view from the right side of FIG. 5.
Figure 3:
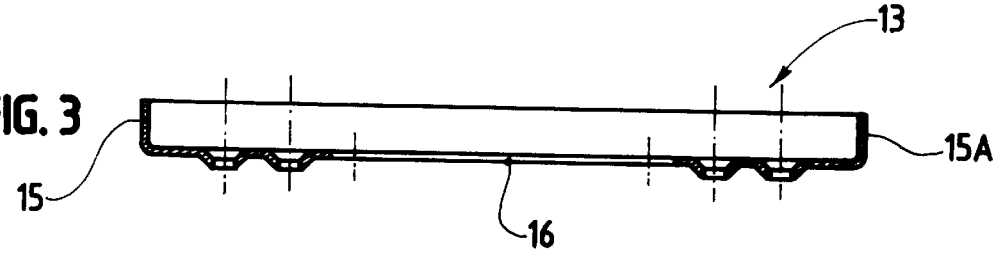
FIG. 3 is a schematical and longitudinal cross-sectional view of the case.
Figure 4:
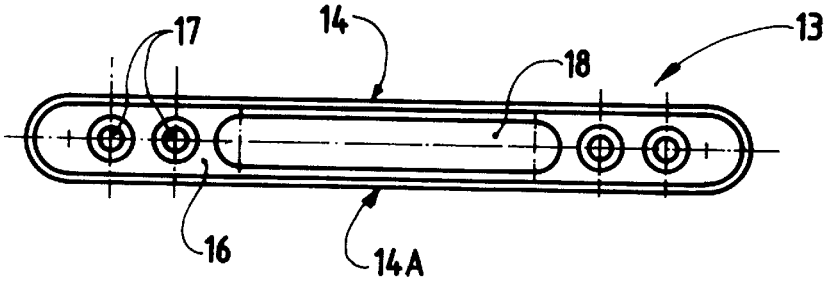
FIG. 4 is a schematical plan view of this case.
Figure 5:
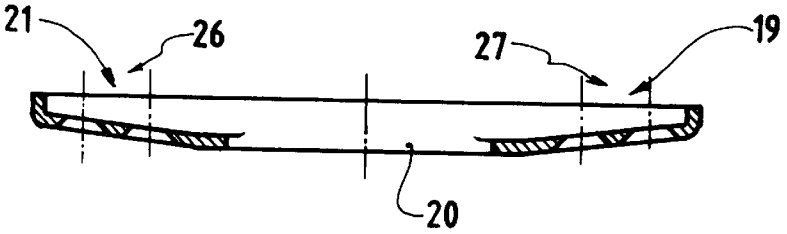
FIG. 5 is a schematical and longitudinal crosssectional view of the cap of the keeper.

Under such circumstances, it is however convenient to position and to ensure the maintaining of said keeper 5 and viz. of its bearing means 22 on the sash-frame 8 during the placing and the tightening of the fixing organs 28. To this end and according to a first embodiment, the shoe 24 includes a cross-section adjusted within close tolerances to the groove 23. As shown in FIGS. 6 and 7, this shoe 24 may however also receive, at the level of its side walls 29, 30, retaining means 31, in the shape of wedges, ridges, ribs or the like, aimed at ensuring the immobility in translation of these bearing means 22 in the groove 23.

According to another feature of this invention, the opening or openings 32 for the passing through of fixing organs 28 provided for in these bearing means 22, in particular the elementary parts 22A and 22B defining these latter, have an elongated shape facilitating the relative positioning of the cap 19 on its bearing means 22.

As already stated several times above, these latter are adapted to the configuration of the carpentry of the sash-frame 8. In addition, it should be noticed that, depending on the backlash which is present in the fillister between the sliding leaf 4 and the sash-frame 8 and/or the protruding portion of the locking organ 2, it is necessary to adjust the positioning of the keeper 5. In particular, one can think of putting at the carpenter's disposal several sets of elementary parts 22A and 22B defining the bearing means 22, which, as a matter of fact, allow him to adapt the positioning of the keeper 5 with respect to this backlash in the fillister.

Finally, one notices that such a burglarproof device 33 can easily be fitted subsequently on a locking fitting that was initially deprived of it and which a sliding-type door, window or the like is now already provided with.

The foregoing disclosure and description of the invention is illustrative and explanatory thereof. Various changes in the details of the illustrated apparatus may be made within the scope of the appended claims without departing from the true spirit of the invention. The present invention should only be limited by the following claims and their legal equivalents.

We claim:

1. A burglarproof apparatus comprising:

a sliding leaf having a front edge with a locking organ protruding therefrom;

a sash-frame having a stile formed thereon, said sash-frame having a keeper inserted against said stile, said locking organ being cooperative with said keeper, said sash-frame having a bearing set; and a case having an inner wall and an outer wall extending from a bottom, said inner and outer walls being integrally formed with said bottom, said inner and outer walls extending parallel to a plane of said sliding leaf, said bottom positioned against a faceplate at said front edge of said sliding leave, said bottom of said case adapted to be fixable against said faceplate, said bottom having an elongated slot formed therein, said locking organ extending through said elongated slot, said elongated slot adapted to limit a travel of said locking organ, said keeper comprising:

a cap having an opening formed in a surface thereof, said opening receiving said locking organ therein, said cap having an interior area adapted to cover said bearing set, said cap being inserted against said sash-frame, said bearing set comprising:

a shoe inserted within a groove formed in said sash-frame; and an emerging portion positioned on said cap, said shoe having retaining means thereon for immobilizing a translation of said bearing set in said groove.

2. The apparatus of claim 1, said inner and outer walls of said case being connected by end walls.

3. The apparatus of claim 1, said shoe having a pair of elementary parts being spaced from each other so as to define a passageway therebetween, said passageway adapted to allow said locking organ to pass into said cap through said opening in said cap.

4. The apparatus of claim 3, said pair of elementary parts having elongated openings formed respectively therein, said elongated openings adapted to allow a fixing organ to pass therethrough, said fixing organ for connecting said cap to said bearing set and for connecting the bearing set to said sash-frame.

* * * * *